United States Patent [19]

Schuler

[11] 4,243,165

[45] Jan. 6, 1981

[54] SHOTGUN BUTT CUP

[76] Inventor: Larry Schuler, 7650 Spring Park Dr., Youngstown, Ohio 44512

[21] Appl. No.: 51,432

[22] Filed: Jun. 22, 1979

[51] Int. Cl.[3] ..... F41C 29/00; F41C 7/00

[52] U.S. Cl. ..... 224/149; 2/94

[58] Field of Search ..... 2/94, 2; 224/149, 150, 224/200, 255, 257, 913

[56] References Cited

U.S. PATENT DOCUMENTS

| | | | |
|---|---|---|---|
| 476,246 | 6/1892 | Burgess | 224/913 |
| 1,519,123 | 12/1924 | Edwards | 2/94 |
| 2,536,252 | 1/1951 | Bates | 224/149 |
| 3,081,923 | 3/1963 | Bagby | 224/913 X |
| 3,708,801 | 1/1973 | Davis | 2/94 |

*Primary Examiner*—H. Hampton Hunter

*Attorney, Agent, or Firm*—Webster B. Harpman

[57] ABSTRACT

A shotgun butt cup comprises an elongated cup-shaped pad for receiving the butt portion of a shotgun or the like stock. The butt cup is secured to a strap for placement around the shoulder of the user so that the same gun placement and alignment can be maintained on each shot.

3 Claims, 4 Drawing Figures

SHOTGUN BUTT CUP

BACKGROUND OF THE INVENTION (1) Field of the Invention:

This invention relates to gun pads and slings of the type normally used to cushion and support rifles and shotguns on the shoulder of the user.

(2) Description of the Prior Art:

Prior devices have devices have utilized alignment brackets and supportive positioning slings. See for example U.S. Pat. Nos. 476,246 and 2,598,143.

In U.S. Pat. No. 476,246 a breech loading magazine gun is disclosed having a positioning sling and bracket within an outwardly extending stud that engages an opening in the stock of the gun.

Applicant's device is a resilient elongated cup into which the butt portion of a shotgun is placed. The bottom of the butt cup is padded and has a strap to secure it to the shoulder of the user.

In U.S. Pat. No. 2,598,143 a gun sling securing device is disclosed having a strap with a wide padded area secured around the arm of the user and a narrow portion of the strap extends to engage the gun.

Applicant's device uses a strap to secure the butt cup to the shoulder thereby positioning the gun relative to the shoulder of the user .

SUMMARY OF THE INVENTION

A shotgun butt cup comprises an elongated flexible cup-shaped device having a padded insert. A strap positions and secures the butt cup to the shoulder of the user. The flexible butt cup will conform to the butt end of a gun stock placed therein for consistent placement and alignment of the gun in relation to an optimum shooting position.

DESCRIPTION OF THE PREFERRED EMBODIMENT

Figure 2:
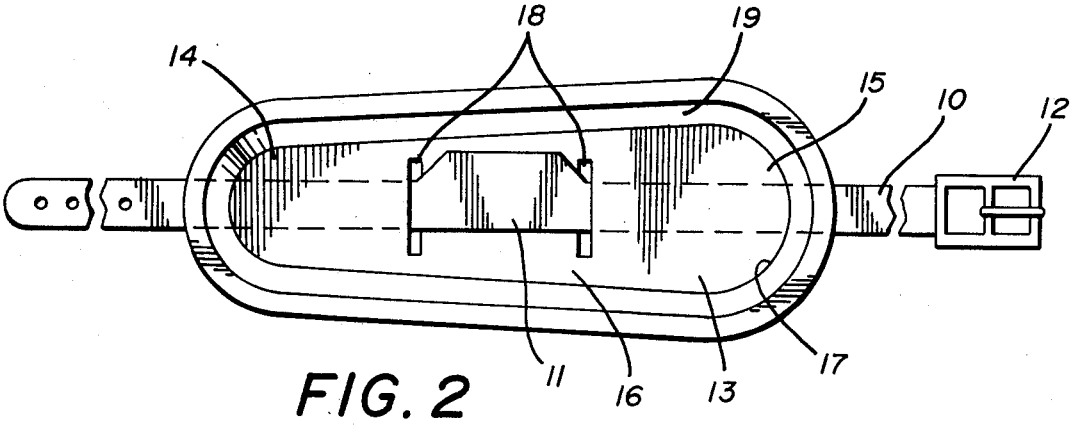
FIG. 2 is a top view of the device.
Figure 4:
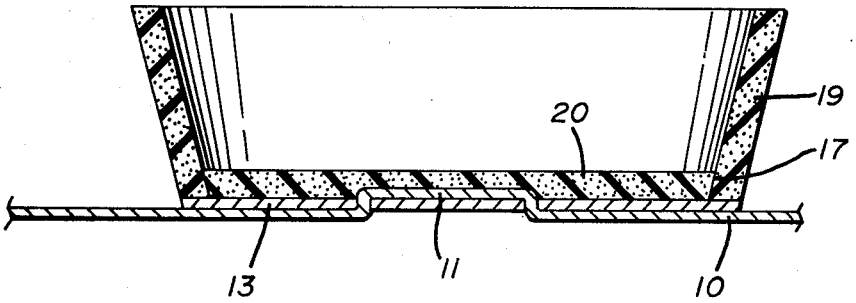
FIG. 4 is a section on line 4—4 of FIG. 3 of the drawings.
Figure 3:
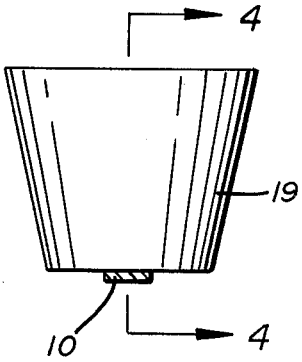
FIG. 3 is an end view.

In the simplest form of the shotgun butt cup of this invention as will be seen in FIGS. 2,3 and 4 of the drawings, it is comprised of a strap 10 having a substantially wider middle portion 11 with a conventional belt buckle fastener 12 on one end thereof. An elongated ovaloid flat base member 13 has ends 14 and 15, a center portion 16 and an edge portion 17.

A pair of spaced slots 18 are positioned in the center portion 16 of the base member 13 and correspond in length to the width of the widest portion 11 of the strap 10. A substantially perpendicular continuous wall 19 extends from the edge portion 17 of the base member 13. The ends 14 and 15 of the base member 13 are of an arcuate configuration with said end 14 having a smaller radius than that of said other end.

Referring now to FIG. 4 of the drawings, it will be seen that a textured foam pad 20 is positioned within the butt cup on the base member 13 and secured thereto.

In use the strap 10 is threaded up through one of the slots 18 and down through the other slot 18 so that the wide middle portion 11 of the strap 10 is centered within the area between the slots 18. The resilient foam pad 20 is then placed in position over the exposed portion of the strap 10.

Figure 1:
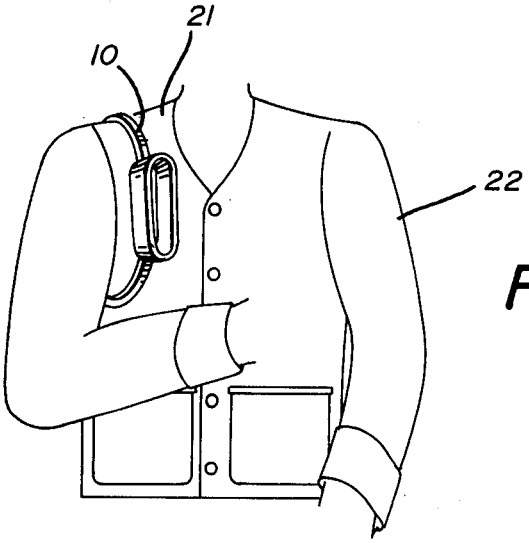
FIG. 1 is a front perspective view of the device positioned on a user.

Referring now to FIG. 1 of the drawings, the strap 10 with the attached butt cup is seen placed around a shoulder 21 of a user 22 and fastened. The butt cup is then adjusted by the user 21 to his particular desired position by inserting the butt end of a rifle or shotgun (not shown) in the butt cup. Once adjusted the user 21 can consistently position the gun in the same location as it is defined by the butt cup, thereby improving his aim and accuracy by consistent placement of the gun to the desired location on the user's shoulder.

The tapered side walls 19 allow for quick and accurate placement by guiding the butt end of a gun into and against the foam pad 19 of the butt cup.

Although but one embodiment of the present invention has been illustrated and described, it will be apparent to one skilled in the art that various changes and modifications may be made therein without departing from the spirit of the invention.

Having thus described my invention what I claim is:

1. A gun butt cup for attachment to a gun user in a preferred location comprises an elongated ovaloid base member, one end portion of which is narrower than the other so as to match the end configuration of a shotgun stock butt, a substantially perpendicular continuous flexible wall on the peripheral edge of said ovaloid base member defining a gun stock butt shaped receptacle for the reception of a gun stock butt, attachment means on said base member for wrap around engagement on a user's shoulder and cushioning means on said base member within said continuous wall.

2. The gun butt cup of claim 1 wherein said flexible attachment means comprises a strap detachably engaged on said base member cup.

3. The gun butt cup of claim 1 and wherein said strap has a wider center section disposed between two slots in said base member.

* * * * *